US007980554B2

(12) United States Patent
Eltzroth et al.

(10) Patent No.: US 7,980,554 B2
(45) Date of Patent: Jul. 19, 2011

(54) FRICTION BACKUP ROLLER FOR MEDIA PICKING

(75) Inventors: Dean Alan Eltzroth, Lexington, KY (US); Kevin Matthew Johnson, Georgetown, KY (US); Michael William Lawrence, Lexington, KY (US); Robert Sandheinrich, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 289 days.

(21) Appl. No.: 11/613,542

(22) Filed: Dec. 20, 2006

(65) Prior Publication Data

US 2008/0150220 A1 Jun. 26, 2008

(51) Int. Cl.
*B65H 3/24* (2006.01)
*B65H 3/52* (2006.01)

(52) U.S. Cl. ..... 271/167; 271/121

(58) Field of Classification Search ..... 271/145, 271/167, 162.121, 162; 399/393
See application file for complete search history.

(56) References Cited

U.S. PATENT DOCUMENTS

| | | | | |
|---|---|---|---|---|
| 6,015,143 | A * | 1/2000 | Jimenez et al. | 271/4.1 |
| 6,227,535 | B1 * | 5/2001 | Bae | 271/121 |
| 7,172,352 | B2 * | 2/2007 | Close et al. | 400/625 |
| 2004/0251602 | A1 * | 12/2004 | Ruhe et al. | 271/167 |
| 2007/0210507 | A1 * | 9/2007 | Izuchi | 271/121 |

FOREIGN PATENT DOCUMENTS

JP 60262735 * 12/1985

* cited by examiner

*Primary Examiner* — Patrick H. Mackey
*Assistant Examiner* — Patrick Cicchino

(57) ABSTRACT

A friction backup roller assembly for a peripheral device, comprising an auto-compensating mechanism having a pick tire at one end, a media tray disposed adjacent to the auto-compensating mechanism, a backup roller extending through an aperture in the media tray, the backup roller having a tire, the auto-compensating mechanism pivotally positioned for engagement and disengagement of the pick tire with the backup roller, and a biasing element acting on the backup roller.

23 Claims, 11 Drawing Sheets

FRICTION BACKUP ROLLER FOR MEDIA PICKING

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention provides a media feeding apparatus. More specifically, the present invention provides a media feeding apparatus which enables feeding of media having a high coefficient of friction which are disposed against a media tray.

2. Description of the Related Art

Various mechanisms have been utilized to feed media into a printer or other peripheral. Various of these mechanisms utilize a tray or bin in order to support a stack of media in which the upper most sheet of the stack may be advanced to a processing station or printing area for printing by a laser printer or inkjet printer, for example. In typical printing or duplicating devices, individual sheets of print media are advanced from the media tray to the processing station by utilizing a paper picking device.

At least one peripheral manufacturer currently uses auto-compensating mechanism (ACM) devices to pick media from a media tray. For example, as related to printers, the L-Path (Top Load) and C-Path printers (Bottom Load) both use the ACM to separate one sheet of paper from the paper stack to feed into the print zone. The ACM is effective because it generates more normal (downward) force as the resistance to moving the paper increases. This keeps the pick tires from slipping as resistance increases. For example, stiff photo paper might have many times the resistance to picking as plain paper. Part of the optimization of the ACM device depends on the friction between each sheet in the stack which is assumed to be similar between each sheet in the stack and within a certain predetermined range. This however leads to a common problem with the design in picking the last sheet. The media trays are typical made of some type of hard plastic that does not have friction similar to that of the media. When the media to plastic friction is too low the last few sheets may be picked together rather than individually, which leads to multi-sheet feeds and paper jams.

Several designs have been made in an attempt to overcome this problem. For example, a soft foam pad may be disposed in the media tray that provides equal or greater friction than the sheet-to-sheet friction so that the last sheet is held in place when the feedingmechanism approaches the bottom of the stack. The foam pad design has been refined for a variety of paper types and used in many peripheral devices including both L-path and C-path printers. However with the advent of micro-porous photo (MPP) papers, an additional problem has manifested. The printed surfaces of MPP papers are soft and have a very high coefficient of friction. The foam pad overcomes the problem of media multi-sheet feeding. However, when feeding the last sheet of media and because the ACM generates more force as the resistance increases, it becomes a self-defeating device if the friction is too high. A polytetrafluoroethylene (PTFE) material, generally known to the public by DuPont's brand name Teflon®, has been located at a lower elevation than the pad so that the downforce of the ACM compresses the foam pad causing the media to engage the PTFE material allowing the sheet to feed. However, the cost per unit is high with the PTFE—foam pad arrangement and tolerances involved in such structure have been extremely difficult to control. For example, when the PTFE material elevation is too high, multi-sheet feeds are likely to occur. Conversely, when the Teflon is too low, pick problems previously described occur. Further, print motor stalls were common with such design rendering it unreliable.

What is needed is a media feeding mechanism that is usable with both lightweight media and heavier, thicker photo media and also inhibits multi-sheet feeds while allowing feeding of the last media sheet when normal force increases.

SUMMARY OF THE INVENTION

A friction backup roller assembly comprises a media tray having a surface for positioning media, at least one aperture disposed in the media tray, at least one backup roller having a tire rotatably supported disposed in each of the at least one aperture, a biasing element extending from the tray toward the aperture and engaging the backup roller. The assembly further comprises an auto-compensating mechanism disposed above the media tray. The auto-compensating mechanism includes a pick tire operably biased toward the backup roller during media feeding. The backup roller extends through the at least one aperture below and above the surface. The biasing element is integral with the tray. The assembly further comprises first and second opposed roller mounts. The first and second roller mounts depending from beneath the surface of the tray. The roller mounts receive a shaft extending through the roller and rotatably supporting the roller within the aperture of the tray.

A friction backup roller assembly for a peripheral device, comprises an auto-compensating mechanism having a pick tire at one end, a media tray disposed adjacent to the auto-compensating mechanism, a backup roller extending through an aperture in the media tray, the backup roller having a tire, the auto-compensating mechanism pivotally positioned for engagement and disengagement of the pick tire with the backup roller, a biasing element acting on the backup roller. The biasing element engages a lower periphery of the backup roller. An upper periphery of the backup roller is disposed above the upper surface of the media tray. The friction backup roller assembly further comprises first and second roller mounts depending from the media tray. The first and second roller mounts rotatably supporting the backup roller. The friction backup roller assembly further comprises a friction brake engaging the backup roller, the biasing element engaging the friction brake. The biasing element is mounted coaxially with the backup roller and applies a force to the backup roller.

A friction backup roller assembly comprises a media tray having an input end and an output end, at least one aperture disposed toward the output end of the media tray, opposed roller mounts depending from the media tray and rotatably supporting a backup roller in the aperture, an auto-compensating mechanism pivotally mounted above the media tray for engagement and disengagement of the backup roller, a biasing element disposed between the roller mounts and engaging the backup roller. The friction backup roller assembly further comprises the biasing element applying a drag force to the backup roller. Additionally, the biasing element inhibits rotation of the backup roller when feeding light weight media. Further in the friction backup roller assembly the rotation and downforce created by the auto-compensating mechanism with photo media overcomes the drag force and causes the backup roller to rotate. The friction backup roller assembly further comprises first and second pick tires engaging first and second backup roller assemblies respectively. The biasing element extends from the media tray. The friction backup roller assembly further comprises a friction brake disposed between the biasing element and the backup roller.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
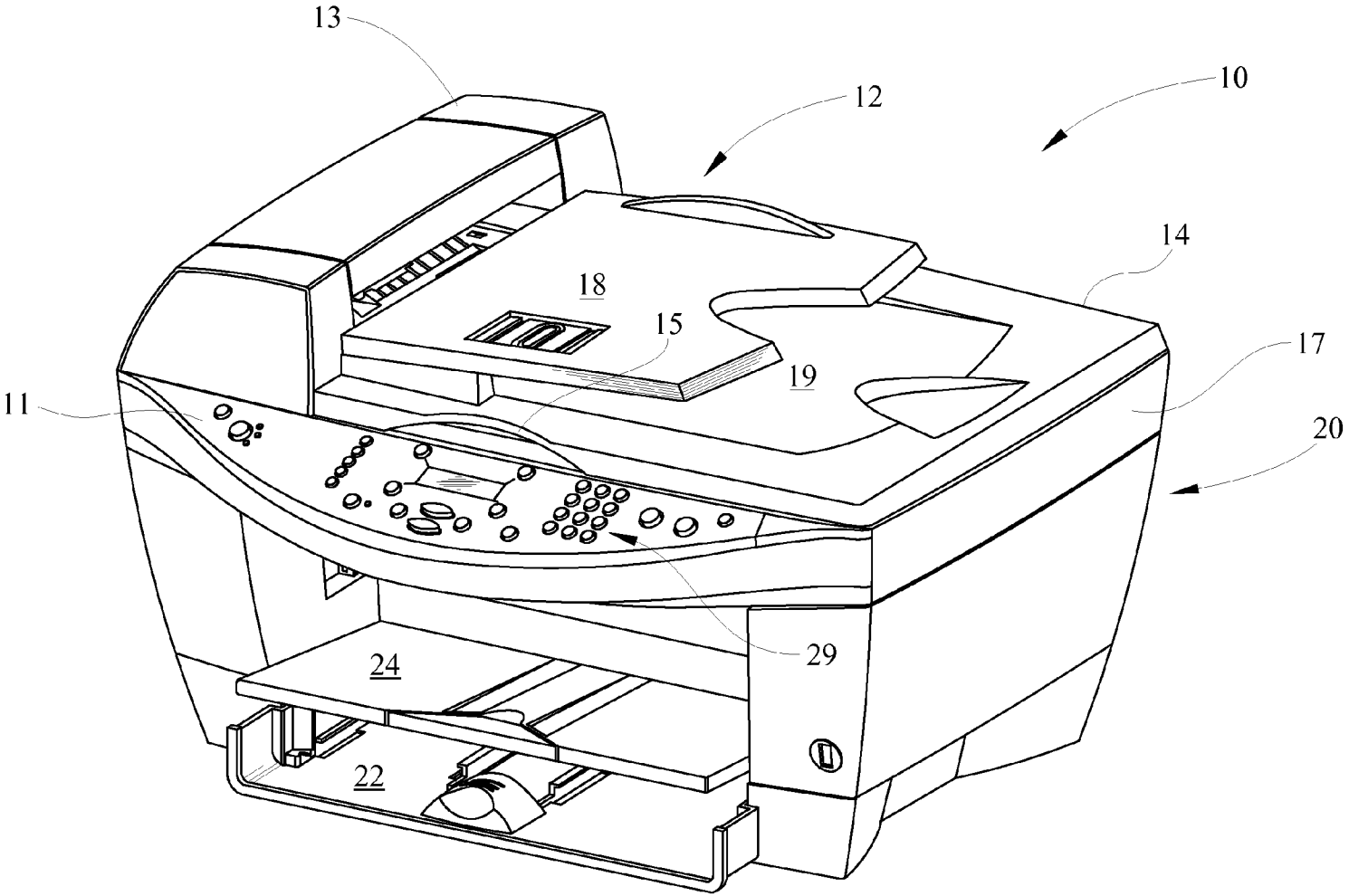
FIG. 1 is a perspective view of an exemplary peripheral device.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

The term image as used herein encompasses any printed or digital form of text, graphic, or combination thereof. The term output as used herein encompasses output from any printing device such as color and black-and-white copiers, color and black-and-white printers, and so-called "all-in-one devices" that incorporate multiple functions such as scanning, copying, and printing capabilities in one device. Such printing devices may utilize ink jet, dot matrix, dye sublimation, laser, and any other suitable print formats. The term button as used herein means any component, whether a physical component or graphic user interface icon, that is engaged to initiate output.

Referring initially to FIG. 1, an all-in-one device 10 is shown having an scanner portion 12 and a printer portion 20, depicted generally by the housing. The all-in-one device 10 is shown and described herein, however one of ordinary skill in the art will understand upon reading of the instant specification that the present invention may be utilized with a stand alone printer, copier, scanner or other peripheral device utilizing a media feed system. The peripheral device 10 further comprises a control panel 11 having a plurality of buttons 29 for making command selections or correction of error conditions. The control panel 11 may include a graphics display to provide a user with menus, choices or errors occurring with the system.

Extending from the printer portion 20 is an input tray 22 and an output tray 24 along the front of the device 10 for retaining media before and after a print process, respectively. The input and output trays 22, 24 of the printer portion 20 define start and end positions of a media feedpath (not shown) within the printer portion 20. The media trays 22, 24 each retain a preselected number of sheets defining a stack of media (not shown) which will vary in height based on the media type. One skilled in the art will understand that the media feedpath 21 illustrated is a C-path media feed due to the depicted configuration.

The printer portion 20 may include various types of printing mechanisms including dye-sublimation, ink-jet or laser printing. For ease of description, the exemplary printer portion 20 may be an inkjet printing device although such description should not be considered limiting. According to such exemplary embodiment, the printer 20 includes a carriage (not shown) having a position for placement of at least one print cartridge (not shown). Alternatively, two print cartridges may be utilized, for instance, a color cartridge for photos and a black cartridge for text printing may be positioned in the carriage. As one skilled in the art will recognize, the color cartridge may include three inks, i.e., cyan, magenta and yellow inks. Alternatively, in lower cost machines, a single cartridge may be utilized wherein the three inks, i.e., cyan, magenta and yellow inks are simultaneously utilized to provide the black for text printing or for photo printing. As a further alternative, a single black color cartridge may be used. During advancement, media M moves from the input tray 22 to the output tray 24 through the substantially C-shaped media feedpath beneath the carriage and cartridge. As the media M moves into a printing zone, beneath the at least one ink cartridge, the media M moves in a first direction and the carriage and the cartridges move in a second direction which is transverse to the movement of the media M. During this movement, ink is selectively ejected onto the media to form an image.

Referring still to FIG. 1, the scanner portion 12 generally includes an ADF scanner 13, a scanner bed 17 and a lid 14 which is hingedly connected to the scanner bed 17. Beneath the lid 14 and within the scanner bed 17 may be a transparent platen for placement and support of target or original documents for manually scanning. Along a front edge of the lid 14 is a handle 15 for opening of the lid 14 and placement of the target document on the transparent platen (not shown). Adjacent the lid 14 is an exemplary duplexing ADF scanner 13 which automatically feeds and scans stacks of documents which are normally sized, e.g. letter, legal, or A4, and suited for automatic feeding. Above the lid 14 and adjacent an opening in the ADF scanner 13 is an ADF input tray 18 which supports a stack of target media or documents for feeding through the auto-document feeder 13. Beneath the input tray 18, the upper surface of the lid 14 also functions as an output tray 19 for receiving documents fed through the ADF scanner 13.

Figure 2:
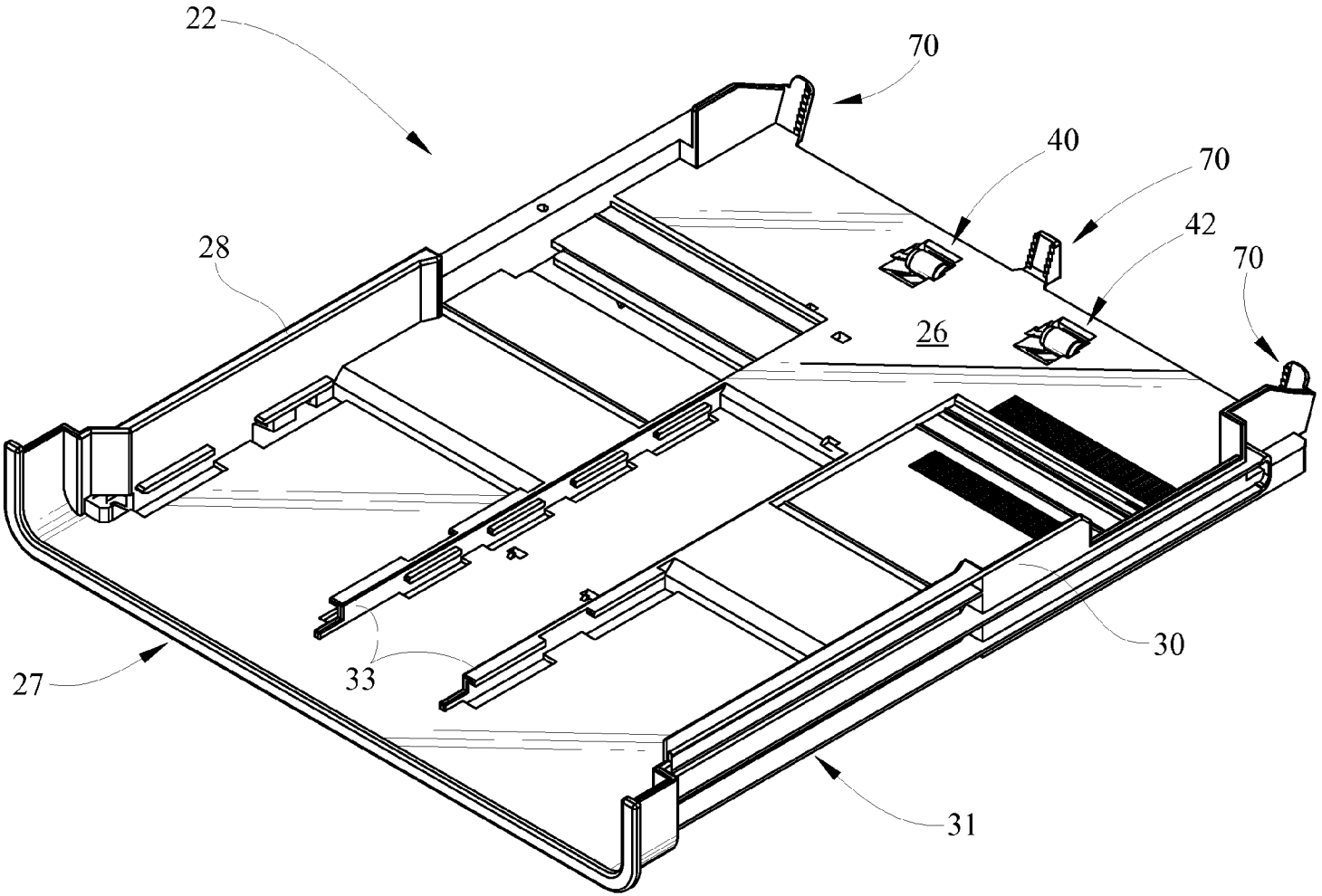
FIG. 2 is a perspective view of a media tray.

Referring now to FIG. 2, the media tray 22 is depicted having a first side wall 28, a second side wall 30 and a tray surface 26 generally extending between the side walls 28, 30. The media tray 22 retains a stack of media for feeding into a peripheral device and printing, scanning or other such process. On outer surfaces of the side walls 28, 30 are slides 31 which engage rib members (not shown) within the peripheral device 10 so that the input tray 22 may be slideably moved inwardly and outwardly from the device 10. This function allows for loading of media M when the tray 22 is empty. The ends of the tray surface 26, between the side walls 28, 30, are generally open. At one end 27, the media stack may be inserted and is generally supported on the tray surface 26 and by raised rails 33 extending along the tray 22. The tray 22 may be formed of various materials including moldable plastics.

Also located opposite end 27 of tray 22 are media abutments 70 which engage the media stack ends during loading. When media is inserted in the tray 22, the leading edge engages the abutments 70 which are tapered and stepped. The stepped arrangement aids in separation of the media before picking while the tapered design of the abutment aids feeding while inhibiting media jams.

Figure 5:
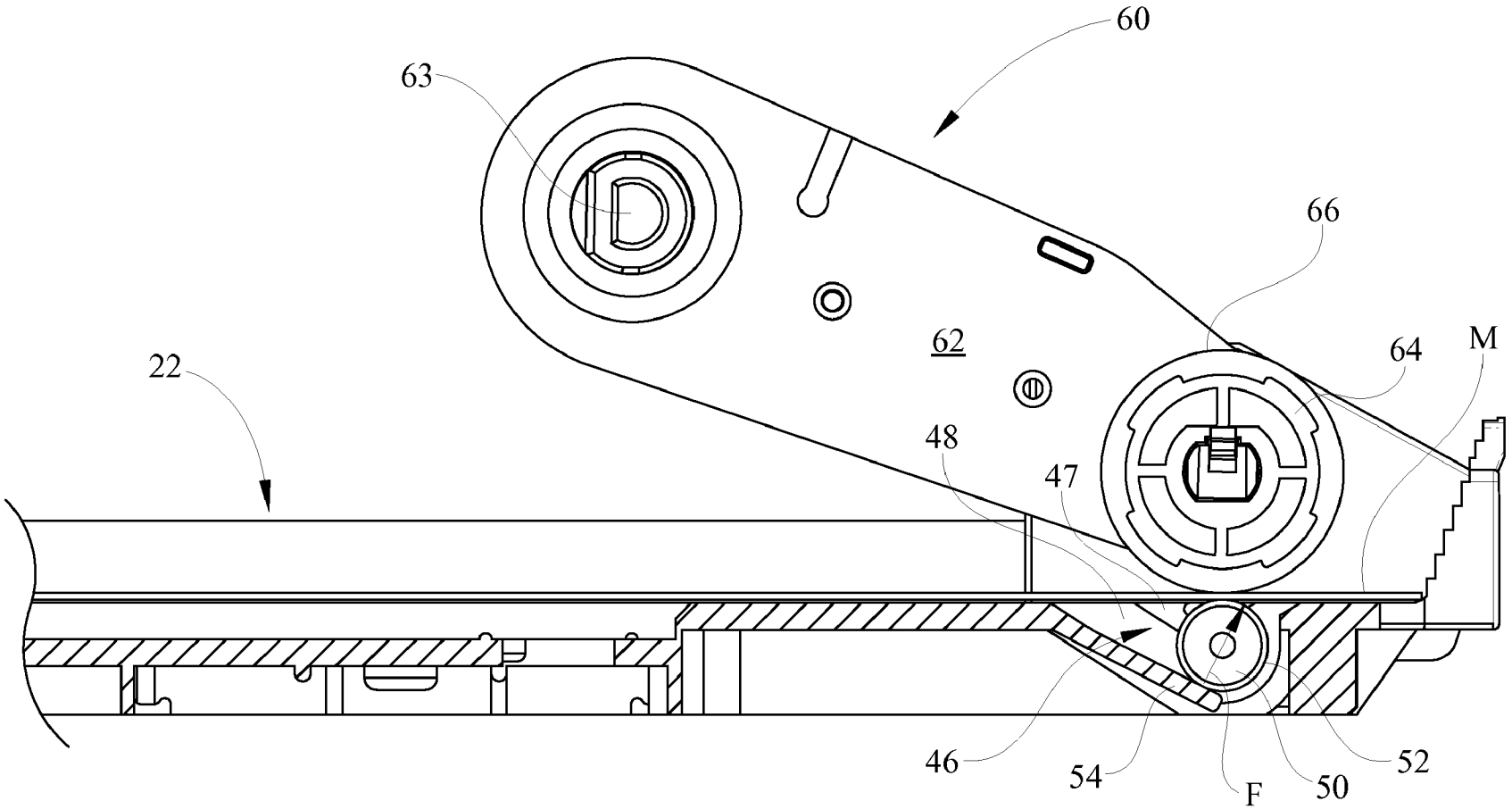
FIG. 5 is a side view of the backup roller of FIG. 3.
Figure 6:
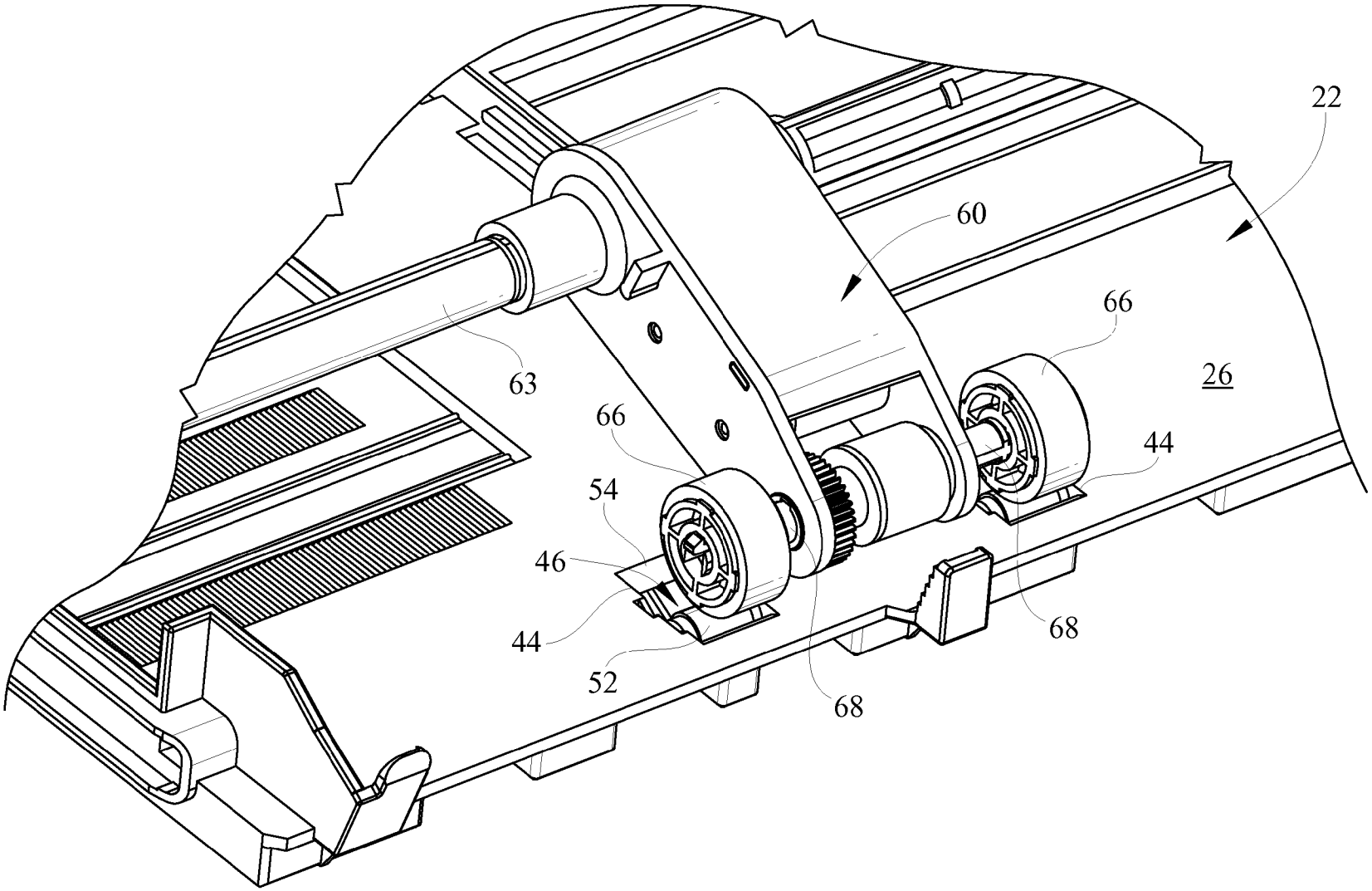
FIG. 6 is a perspective view of the ACM engaging the backup rollers.

Also located opposite end 27, are backup roller assemblies 40, 42. These assemblies are located at an end of the media tray 22 below an auto-compensating mechanism 60 (FIGS. 5, 6). The backup roller assemblies 40, 42 aid in feeding of media from tray 22 as will be described herein.

Figure 3:
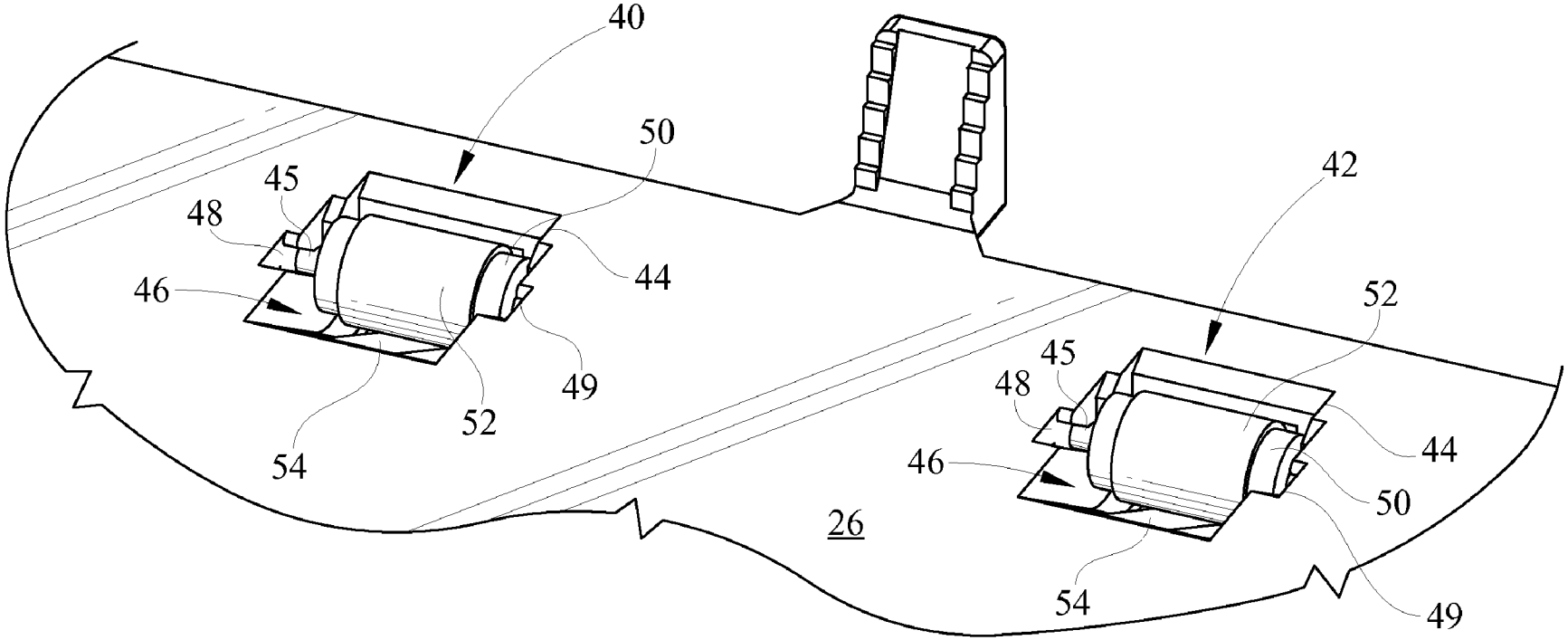
FIG. 3 is a perspective view of the backup rollers.

Referring now to FIG. 3, a partial perspective view of the media tray 22 and tray surface 26 is depicted. The figure also depicts the backup roller assemblies 40, 42 located at one end of the tray surface 26. For ease of description one assembly 40 will be described, however it should be understood from the drawings that one or more backup roller assemblies may be utilized. The backup roller assembly 40 includes an aperture 44 in the surface 26 of tray 22. The aperture 44 is generally rectangular in shape but may comprise various alternative shapes in conjunction with the description of the assemblies 40, 42 herein. Within the bounds of the aperture 44, the material of the tray is removed to define a recess 46 wherein a roller 50 is positioned. Shaft mounts 48, 49 bound the aperture 44 on opposed sides of the recess 46. A slot 47 (see FIG. 5) extends along sides of the mounts 48, 49 facing the recess 46. Each slot 47 descends into the recess 46 at an angle from the vertical. The slots 47 provide a position to locate a shaft 45 within the mounts 48, 49. The angle of slot 47 allows the shaft 45 to be vertically offset from its entry position into the mounts 48, 49.

The shaft 45 extends through the substantially cylindrical roller 50 and is positioned within the opposed shaft mounts 48, 49. The roller 50 has a pre-selected diameter and a tire 52 disposed over the outer surface of roller 50. With the tire 52 positioned over the outer surface of the roller 50, the outer peripheral surface of the tire 52 is disposed at an elevation that is slightly above the tray surface 26. Thus, media stacked on the surface 26 of tray 22 positively engages the tire 52. The roller 50 may be formed of plastic and the tire 52 may be formed of high friction isoprene or other high friction materials. The tires 52 function by retaining the media stacks in place while feeding occurs inhibiting multi-sheet feeds when the last sheet is to be fed, the tire 52 rotates due to a preselected downforce being applied to the tire.

Figure 4:
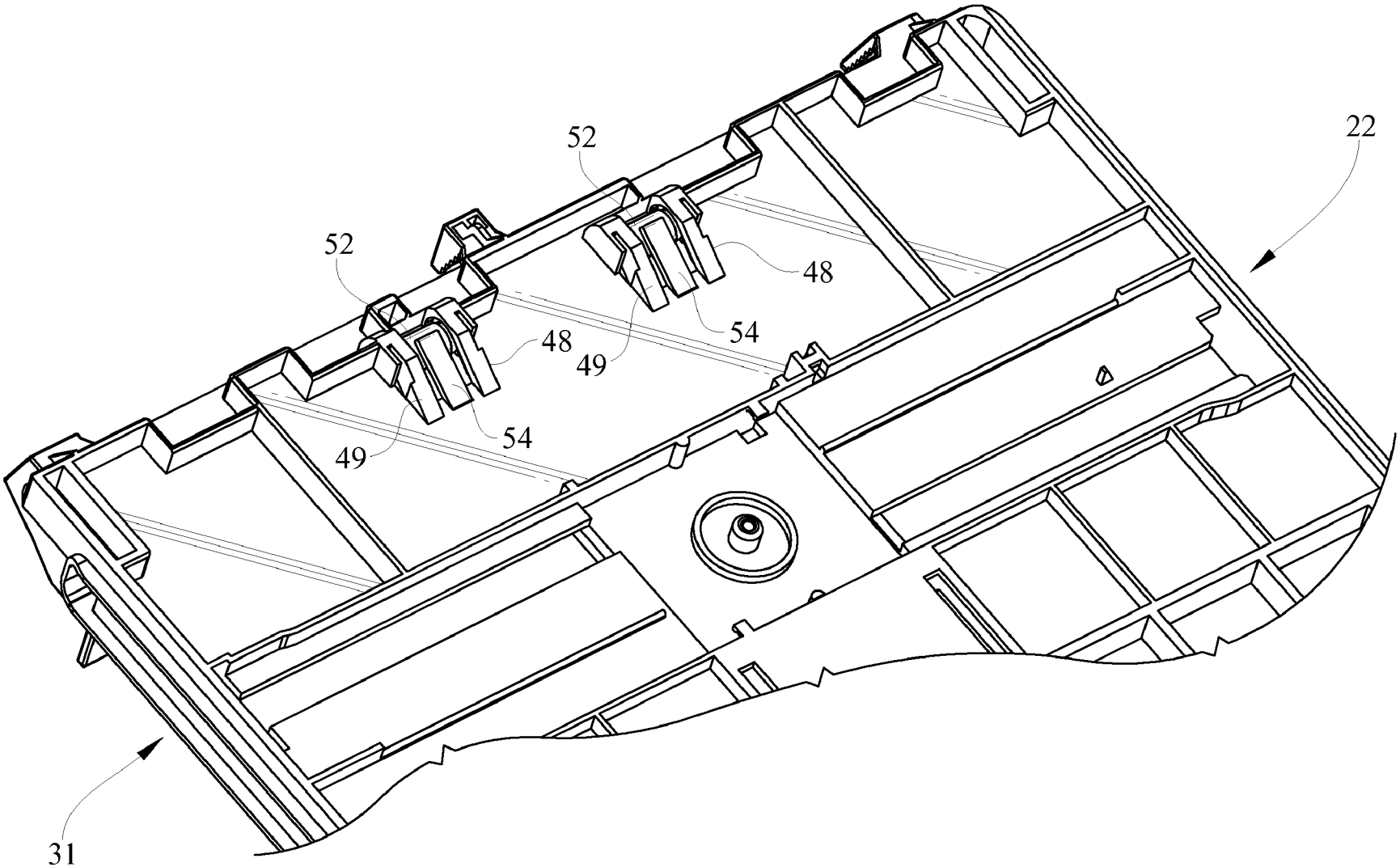
FIG. 4 is a perspective view of the backup rollers from beneath the media tray.

Referring now to FIG. 4, the shaft mounts 48, 49 are depicted beneath the tray 22, depending from the lower surface 26. According to the exemplary embodiment, the mounts 48, 49 are molded into the tray 22, but could be formed in various ways. The shaft mounts 48, 49 may be various shapes but are shown having the greatest depth where the roller 50 and tire 52 are positioned to define the recess 46. The mounts 48, 49 are tapered from a position spaced from the tire 52 toward the lower surface of tray 22. It should be understood that various shapes could be utilized.

Disposed between the shaft mounts 48, 49 are biasing elements 54 which are molded plastic elements integral with the tray 22 and extending at an angle from the lower surface of tray 22 to the tires 52. When the roller 50 and tire 52 are positioned in the slot 47, the tire 52 displaces the biasing element 54 so that the reaction force of the element 54 acts on tire 52 and inhibits rotation of the tire 52 and roller 50. The function of the biasing element 54 is to place a drag force on the tires 52 and rollers 50. The exemplary upward drag force opposes, in part, a normal force placed on the tire 52. As previously indicated, the shaft extending through the roller 50 is disposed between the shaft mounts 48, 49 in a diagonal slot 47 which locates the roller 50 and tire 52 offset vertically from the position where it enters the aperture 44. The biasing element 54 applies a diagonal force upwardly on the roller 50 and tire 52 which is generally perpendicular to the slot 47 where the roller and tire are located inhibiting the roller 50 and tire 52 from moving out of the slot 47 and aperture 44.

Referring now to FIG. 5, a side view of the media tray 22 and adjacent auto-compensating mechanism 60 is depicted. The ACM 60 comprises a housing 62 having a driveshaft 63 which inputs a torque at one end and a plurality of transmission gears within the housing which drive an ACM roller 64. The roller 64 has a pick tire 66 disposed along the outer periphery thereof to engage media M positioned in the media tray 22. The tire 66 is formed of a high friction material such as isoprene or the like, although other materials may be used. Beneath the ACM roller 64 and pick tire 66 is the backup roller 50 and tire 52. In the figure depicted, the media M disposed between the ACM roller 64 and tire 52 inhibit the two from touching. However, the tire 66 and tire 52 would touch if the media were removed.

As depicted, the biasing element 54 places a diagonally upward force F through the axis of the roller 50. The force is substantially perpendicular to the angle of the slot 47 wherein the shaft for the roller 50 is positioned, although this should not be construed as limiting. A horizontal component of the force F has the same horizontal direction as the slot 47. Thus the force F also helps to maintain the roller 50 within slot 47.

In other words, the direction of force F does not force the roller 50 from the recess 46 through the slots 47.

Referring to FIG. 6, the ACM 60 and tray 22 are depicted in perspective view. The ACM is shown, with media removed from tray 22, and engaging the tire 52 of backup roller 50. In this view, each pick tire 66 is shown engaging a backup roller assembly 40, 42, respectively. It should be understood that while two backup roller assemblies 40, 42 are depicted any number may be utilized corresponding to the number of pick tires used with the ACM 60. One skilled in the art will recognize that the ACM 60 places a variable normal force on the tire 52.

Figure 7:
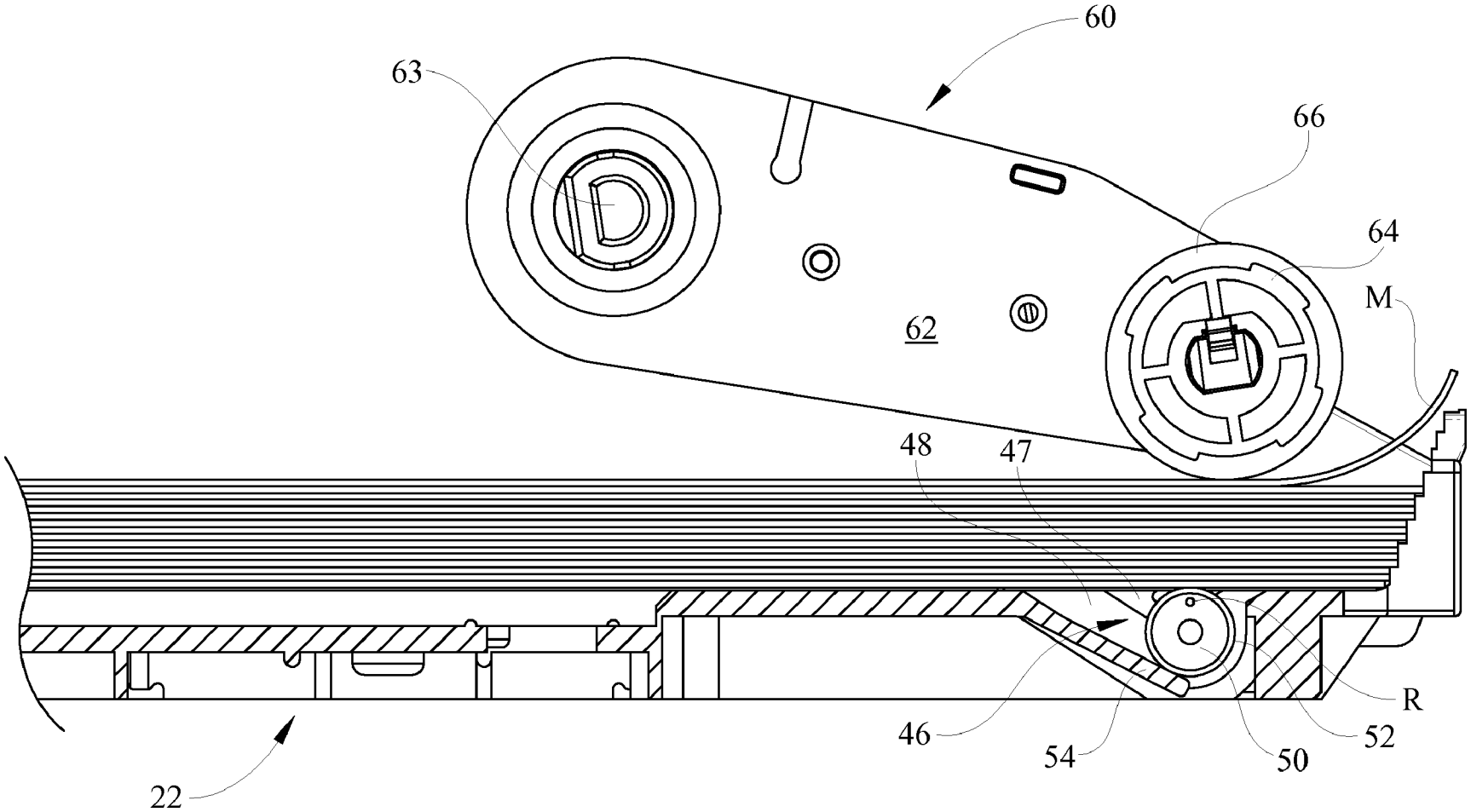
FIG. 7 is a side sequence view of the media tray with a substantial stack of media being fed.
Figure 8:
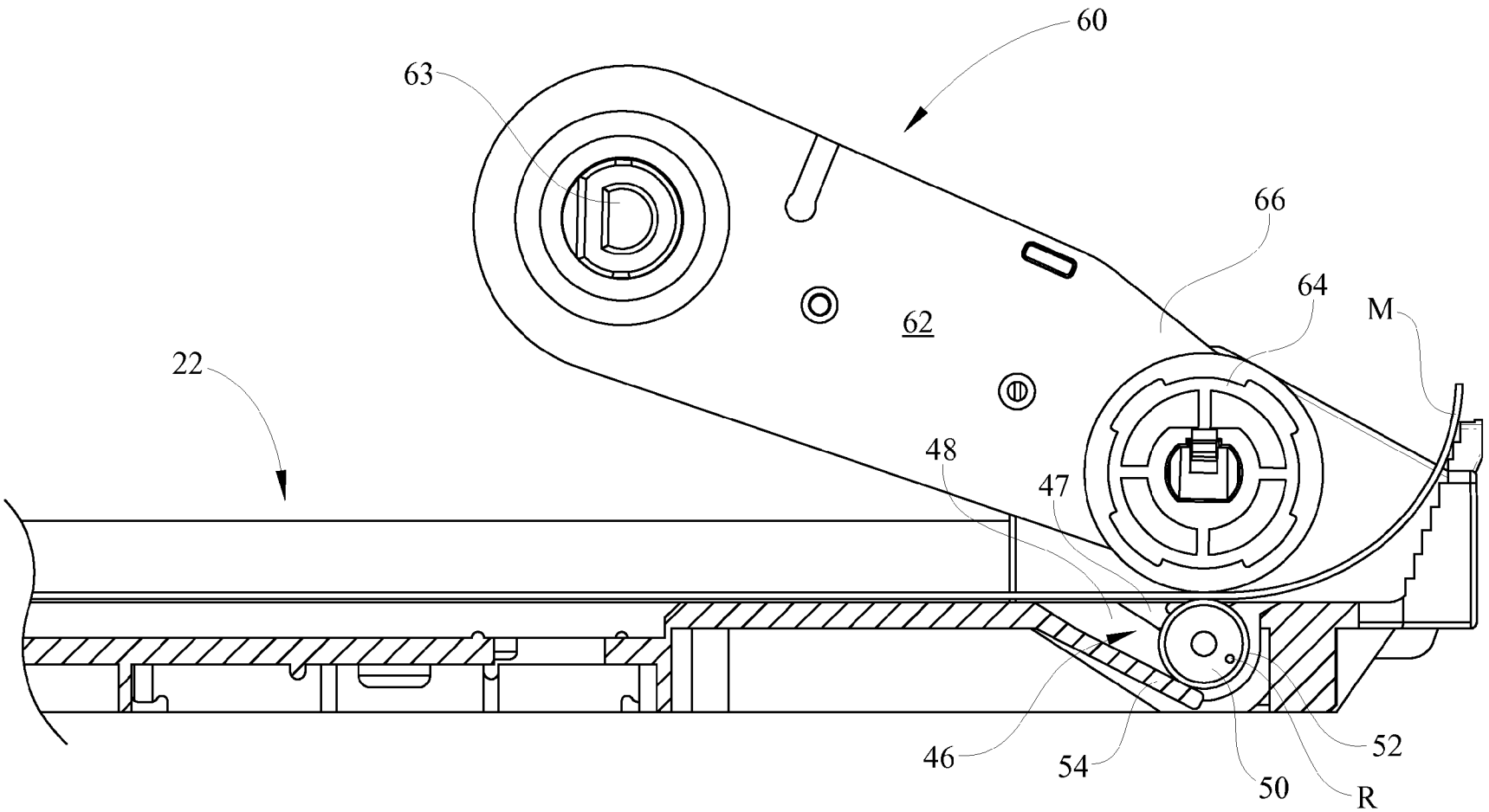
FIG. 8 is a side view of the media tray with a single sheet of media being fed and further depicts the rotation of the backup roller.

Referring now to FIG. 7-8, during operation a stack of media M is loaded into the tray 22 and pushed forward to the angled media abutments 70. Due to the height of media stack, the ACM 60 is oriented in a substantially horizontal position. As the driveshaft 63 is rotated and the ACM roller 64 and pick tire 66 correspondingly rotate, the ACM 60 creates a normal force or downforce overcoming the friction of the adjacent media sheet and advancing the media from the tray 22 into the peripheral device. As the media feeds from the tray 22, the ACM 60 moves downwardly pivoting about the driveshaft 63 as the media stack height decreases. Further, the ACM 60 has the characteristic of increasing the normal force in response to increased friction during operation. As media feeds through the peripheral device, the downforce from the ACM 60 is not great enough to overcome the friction of element 54. Thus roller 50 and tire 52 do not rotate. Since the tire 52 does not rotate, the feeding assembly will only feed a single sheet of media at a time. Thus, the problem of multi-sheet feeds from a media stack is overcome by the stationary high coefficient of friction tire 52. When the pick tire 66 engages the last sheet of media (see FIG. 8), the media sheet has a different friction than the previous sheets because the coefficient of friction between the sheet M and the tray 22 material is different from the sheet to sheet coefficient of friction. However, due to the lower position of the ACM 60, the normal force increases overcoming the spring force of biasing element 54. Accordingly, the roller 50 and tire 52 rotate with the rotation of the pick tire 66 and the last sheet of media is fed into the peripheral device 10. This rotation is indicated by the rotation of the rotation mark R on roller 50 from its position in FIG. 7 to its position in FIG. 8.

Figure 9:
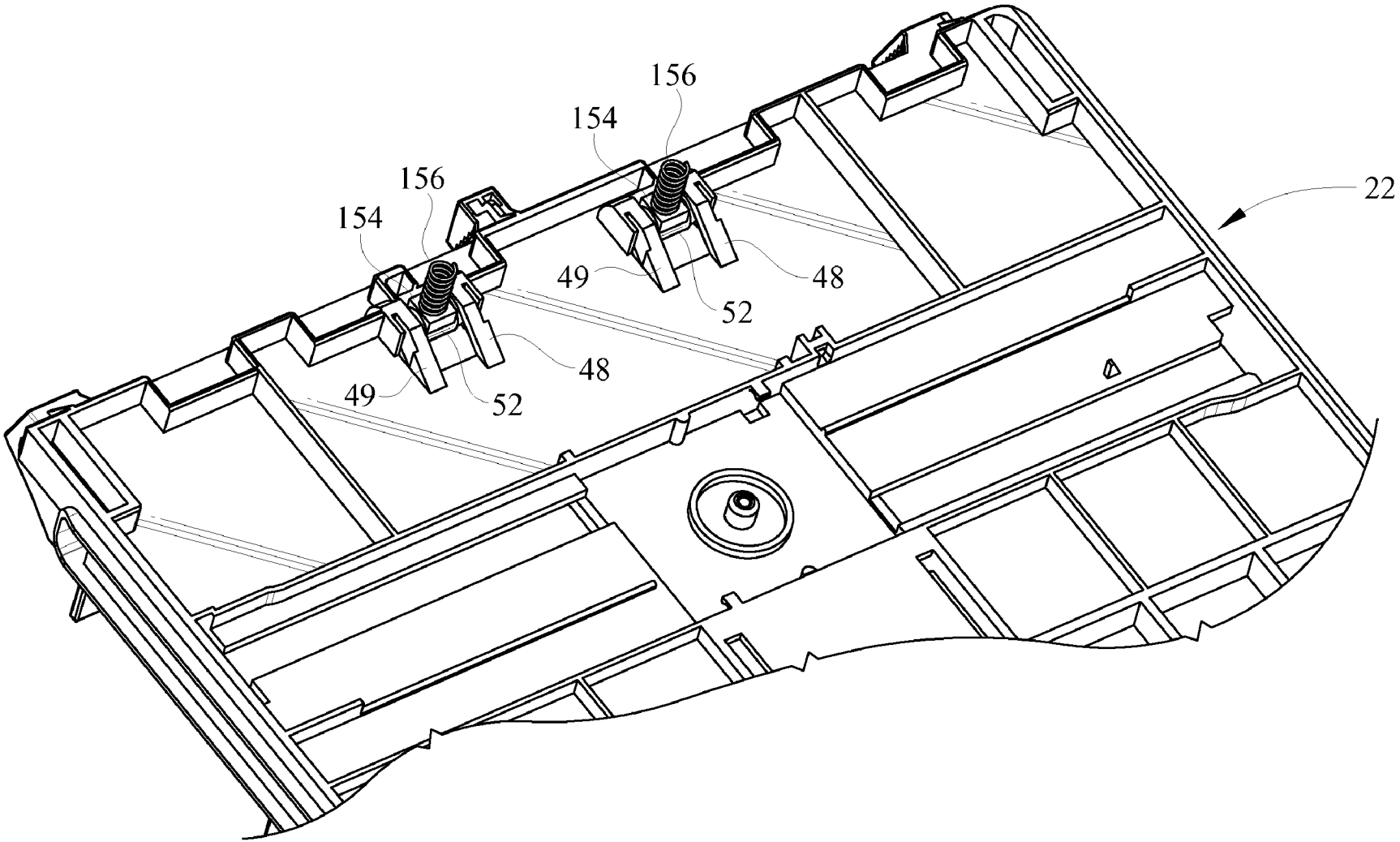
FIG. 9 is a lower perspective view of an alternative exemplary embodiment.

Referring now to FIG. 9, an alternative embodiment of the present friction backup roller design is depicted. FIG. 9 specifically depicts a lower perspective view of the media input tray 22. Depending from the lower surface of the tray 22 are two pair of opposed mounts 48, 49. Between each of the mounts 48, 49 is a friction backup roller 52 rotatably connected to the mounts 48,49. As previously described, the backup roller 52 extends through the tray 22 and engages media disposed on the upper surface of the tray 22.

Engaging the backup friction rollers 52 are friction brakes 154 which are biased toward the roller 52 by compression springs 156. Each of the compression springs have two ends: a free end opposite the brake 154 and a second end connected to the brake 154. When the tray 22 is installed in the peripheral 10, the free end of the spring 156 engages a fixed structure on the interior of the peripheral, such as the midframe (not shown) to provide force on the friction brake 154. As a result, a drag force is placed on the roller 52.

During operation the spring 156 applies a force to the brake 154 and on the friction back up roller 52. The force inhibits the rotation of the roller 52 and therefore inhibits multi-sheet feeds during media feeding. When the media stack reaches the last sheet, the down force of the ACM 60 increases to an amount which overcomes the braking force of the brake 154 and spring 156. This causes the rotation of the roller 52 allowing the last sheet of media to be picked and fed into the printer or other peripheral.

Figure 10:
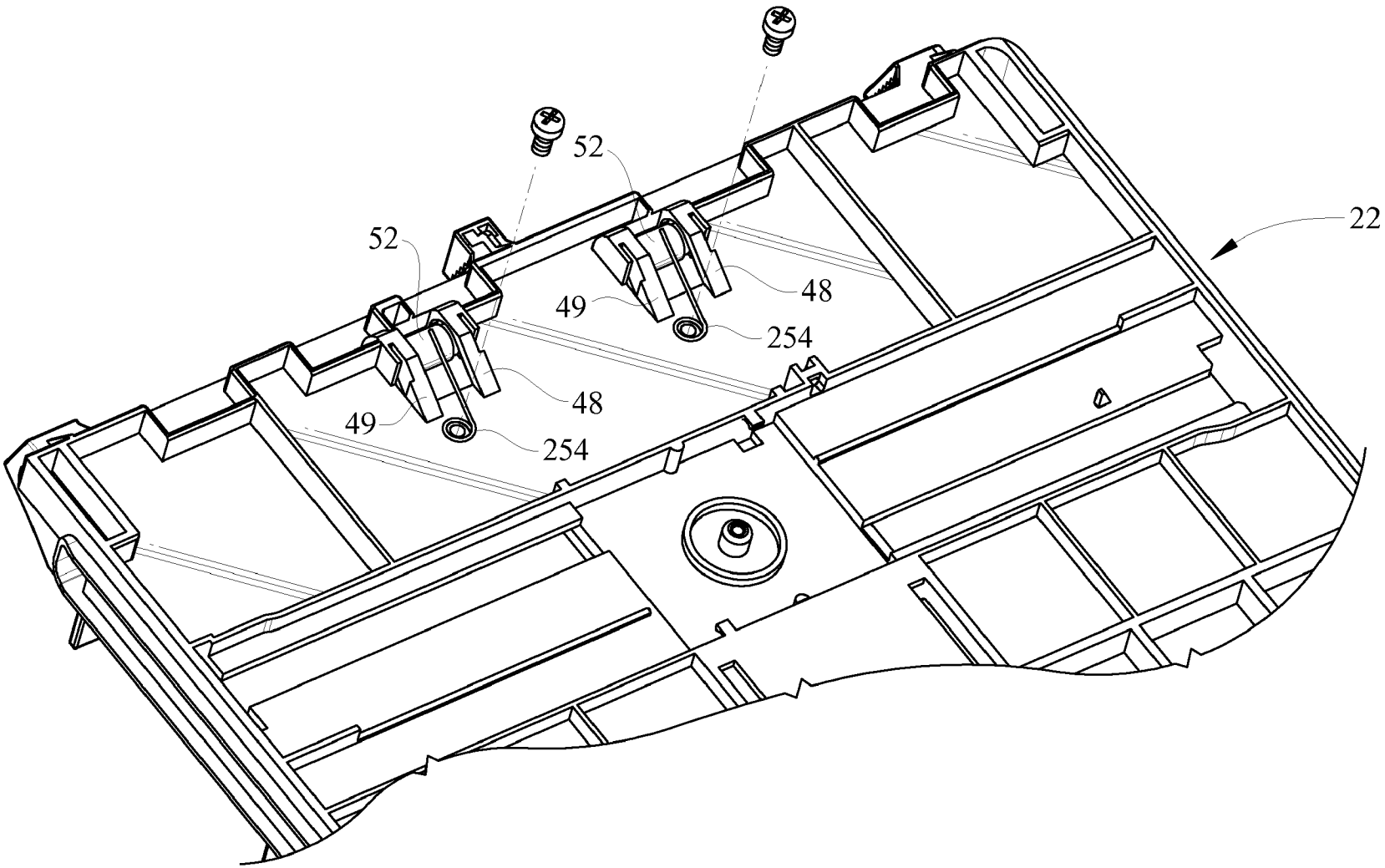
FIG. 10 is a lower perspective view of a second alternative embodiment; and, FIG. 11 is a lower perspective view of a third alternative embodiment.

Referring now to FIG. 10, a lower perspective view of the tray 22 is depicted having a second alternative exemplary embodiment. The tray 22 comprises mounts 48, 49 between which backup friction rollers 52 are rotatably positioned. Adjacent the rollers 52 and the mounts 48, 49 are biasing elements 254 which are formed of wire. According to the exemplary embodiment, the wire springs 254 which are fastened to the tray 22 and provide a drag force on the roller 52. The wire thickness and other characteristics may be utilized to apply a proper force to the roller 52.

During operation the media stack is located on the upper surface of the tray 22 and engages the backup roller 52. The spring force applied by the biasing element 254 inhibits rotation of the backup roller 52. When the media stack reaches the last sheet in the tray 22, the down force of the ACM 60 is such that the spring force is overcome and the roller 52 rotates, allowing feeding of the last sheet of media.

Figure 11:
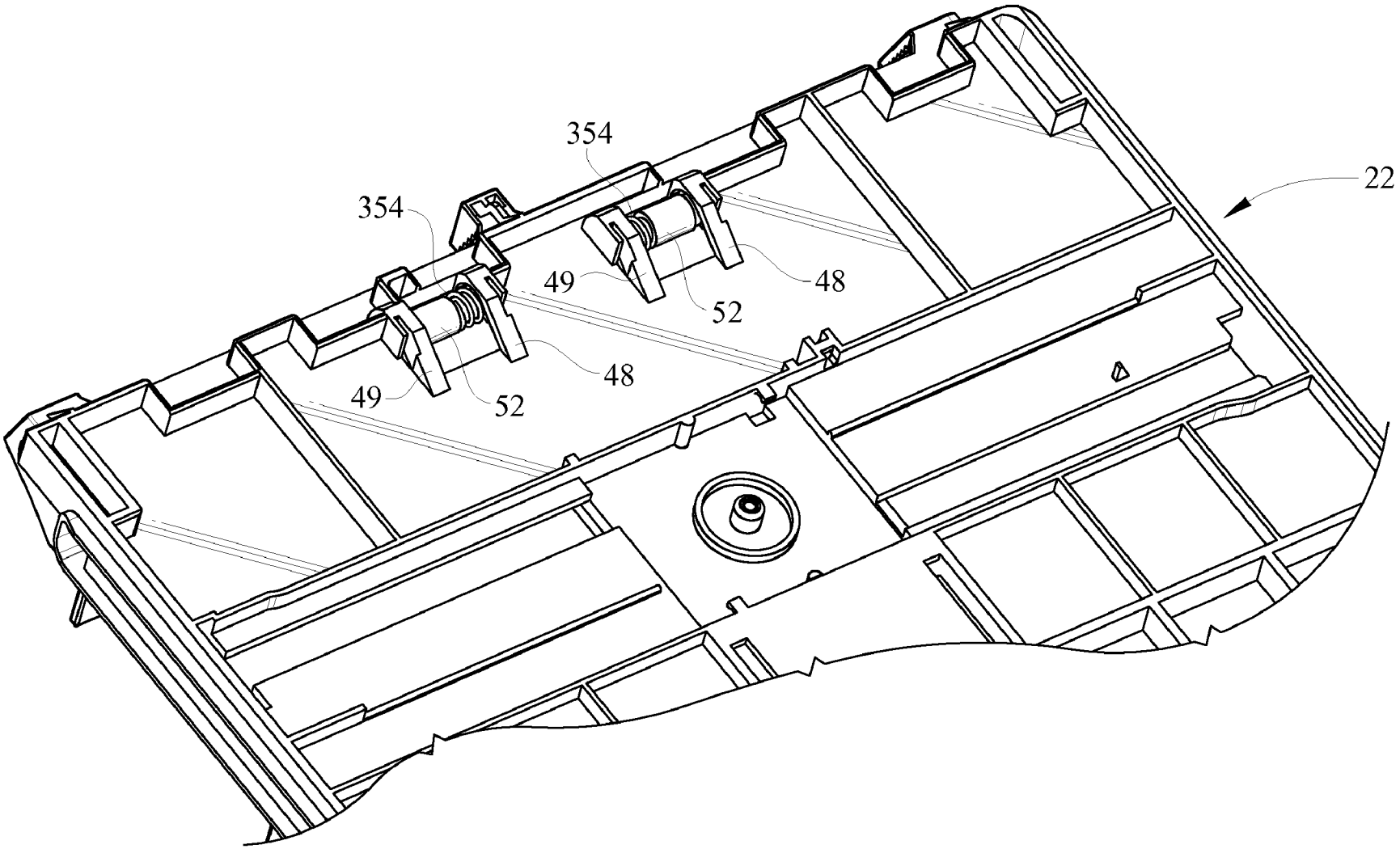

Referring now to FIG. 11, a further exemplary embodiment is depicted. The tray 22 is depicted in a lower perspective view having first and second opposed pairs of mounts 48,49. Rotatably positioned between each pair of mounts 48,49 is a roller 52. Mounted coaxially with each roller 52 and engaging one of the mounts 48,49 is a compression spring 354. The compression spring 354 is compressed between the roller 52 and one of the mounts 48,49 to place a drag force on the roller 52.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. An input media assembly for a printer, comprising:

a media tray having a surface for positioning media, said media tray having at least one aperture disposed therein;

at least one backup roller having a tire rotatably supported disposed in each of said at least one aperture; and a biasing element extending from said tray toward said aperture and directly contacting an outer surface of said tire of the at least one backup roller so as to provide a diagonally upward force on said tire of the at least one backup roller to inhibit its rotation.

2. The assembly of claim 1 further comprising an auto-compensating mechanism disposed above said media tray.

3. The assembly of claim 2 wherein said auto-compensating mechanism includes a pick tire operably biased toward said at least one backup roller during media feeding.

4. The assembly of claim 1 wherein said at least one backup roller extends through the at least one aperture below and above said surface.

5. The assembly of claim 1 wherein said biasing element is integral with said tray.

6. The assembly of claim 1 further comprising first and second opposed mounts for said at least one backup roller.

7. The assembly of claim 6, wherein said first and second opposed mounts for said at least one backup roller depend from beneath said surface of said tray.

8. The assembly of claim 7, said first and second opposed mounts for said at least one backup roller receive a shaft extending through said at least one backup roller and rotatably support said at least one backup roller within said at least one aperture of said tray.

9. An assembly for a peripheral device, comprising:

an auto-compensating mechanism having a pick tire at one end;

a media tray disposed adjacent to said auto-compensating mechanism, said media tray having an aperture therethrough;

a backup roller extending thugh said aperture in said media tray, said backup roller having a tire having a portion extending through said aperture into said media tray;

said auto-compensating mechanism pivotally positioned relative to said pick tire with said backup roller; and a biasing element extending from said tray toward said aperture and directly contacting an outer surface of a portion of said tire not extending through said aperture into said media tray so as to provide a diagonally upward force on said tire of said backup roller to inhibit its rotation.

10. The assembly of claim 9 wherein said biasing element engages a lower periphery of said backup roller.

11. The assembly of claim 9 wherein an upper periphery of said backup roller is disposed above an upper surface of said media tray.

12. The assembly of claim 9, further comprising first and second opposed roller mounts depending from said media tray.

13. The assembly of claim 12 wherein said first and second opposed roller mounts rotatably support said backup roller.

14. An assembly for a printing device, comprising:

a media tray having an input end and an output end, said media tray having at least one aperture disposed toward said output end of said media tray;

at least one backup roller, said backup roller having a tire;

opposed roller mounts depending from said media tray and rotatably supporting said at least one backup roller in said at least one aperture;

an auto-compensating mechanism pivotally mounted above said media tray relative to said at least one backup roller; and at least one biasing element disposed between said opposed roller mounts and directly contacting an outer surface of said tire of the at least one backup roller so as to provide a diagonally upward force on said tire of the at least one backup roller to inhibit its rotation.

15. The assembly of claim 14 wherein said at least one biasing element inhibits rotation of the at least one backup roller when feeding light weight media.

16. The assembly of claim 14 wherein rotation and downforce created by said auto-compensating mechanism with photo media in said media tray overcomes said diagonally upward force causing said at least one backup roller to rotate.

17. The assembly of claim 14 further comprising first and second pick tires on said auto-compensating mechanism engaging first and second backup roller assemblies, respectively, in respective first and second apertures.

18. The assembly of claim 14 wherein said at least one biasing element extends from said media tray.

19. The assembly of claim 1, wherein said at least one biasing element substantially inhibits rotation of said at least one backup roller while a plurality of sheets of media are in said media tray, and allows rotation when about one sheet of media remains in said media tray.

20. The assembly of claim 2, wherein said biasing element comprises a spring member which urges said at least one backup roller in a direction substantially opposed to a direction of force applied by said auto-compensating mechanism.

21. The assembly of claim 9, wherein said biasing element substantially inhibits rotation of said backup roller while a plurality of sheets of media are in the media tray, and allows rotation of said backup roller by said auto-compensating mechanism when about one sheet of media remains in said media tray.

22. The assembly of claim 9, wherein said biasing element comprises a spring member which urges said backup roller in a direction substantially opposed to a direction of force applied by said auto-compensating mechanism.

23. The assembly of claim 14, wherein said at least one biasing element substantially inhibits rotation of said at least one backup roller while a plurality of sheets of media are in said media tray, and allows rotation of said at least one backup roller by said auto-compensating mechanism when about one sheet of media remains in said media tray.

* * * * *